US007924302B2

(12) United States Patent
Fujisawa et al.

(10) Patent No.: US 7,924,302 B2
(45) Date of Patent: Apr. 12, 2011

(54) IMAGE RECORDING APPARATUS WITH GAS BLOWING DEVICE

(75) Inventors: Hiroyuki Fujisawa, Kyoto (JP); Keisuke Hirayama, Kyoto (JP); Hiroshi Okamoto, Kyoto (JP); Junichi Oka, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 586 days.

(21) Appl. No.: 12/003,885

(22) Filed: Jan. 3, 2008

(65) Prior Publication Data

US 2008/0170115 A1 Jul. 17, 2008

(30) Foreign Application Priority Data

Jan. 12, 2007 (JP) ..... 2007-004068

(51) Int. Cl.
*B41J 2/45* (2006.01)

(52) U.S. Cl. ..... 347/238

(58) Field of Classification Search ..... 347/224, 347/225, 238, 241, 242, 256, 257; 219/121.6, 219/121.67–121.69, 121.76
See application file for complete search history.

(56) References Cited

U.S. PATENT DOCUMENTS

| | | | | |
|---|---|---|---|---|
| 4,369,246 | A * | 1/1983 | Chen et al. | 430/306 |
| 5,946,078 | A | 8/1999 | Morimoto et al. | |
| 6,029,028 | A | 2/2000 | Inoue | |
| 6,400,389 | B1 * | 6/2002 | Shaffer et al. | 347/241 |
| 6,494,965 | B1 * | 12/2002 | Walker et al. | 134/21 |
| 7,230,636 | B2 * | 6/2007 | Iwasa et al. | 347/227 |
| 2003/0222970 | A1 * | 12/2003 | Detmers et al. | 347/256 |
| 2004/0179086 | A1 | 9/2004 | Iwasa et al. | |
| 2005/0001894 | A1 | 1/2005 | Isono et al. | |
| 2007/0229646 | A1 | 10/2007 | Ogawa et al. | |

FOREIGN PATENT DOCUMENTS

| | | |
|---|---|---|
| EP | 0 810 489 | 12/1997 |
| EP | 1 839 890 | 10/2007 |

OTHER PUBLICATIONS

European Search Report issued in European Patent Application No. EP 08 00 0299, mailed Jun. 20, 2008.

* cited by examiner

*Primary Examiner* — Hai C Pham
(74) *Attorney, Agent, or Firm* — McDermott Will & Emery LLP

(57) ABSTRACT

A laser light source has a plurality of semiconductor lasers arranged in a direction intersecting a primary scanning direction X. The semiconductor lasers are arranged in such a positional relationship that each semiconductor laser is located upstream, in the primary scanning direction X, of a different semiconductor laser located adjacent thereto and downstream thereof in a direction in which air is blown from an air blowoff pipe.

4 Claims, 8 Drawing Sheets

IMAGE RECORDING APPARATUS WITH GAS BLOWING DEVICE

BACKGROUND OF THE INVENTION

1. Field of the Invention

This invention relates to an image recording apparatus for recording an image on an image recording medium which generates gas, dust and the like through a thermal reaction.

2. Description of the Related Art

In an image recording apparatus using an image recording medium which generates gas and the like through a thermal reaction, the gas and the like could adhere to an objective lens of a recording head, for example, and fog surfaces of the objective lens, thereby lowering the quality of a recorded image. It has therefore been conventional practice to produce an airflow that intersects laser light emitted from the recording head, for diffusing the gas and the like and preventing the gas and the like from adhering to the objective lens of the recording head.

In recent years, a technique has begun to be in practical use which forms a letterpress image directly on an image recording medium called flexo-digital plate by using CTP (computer-to-plate). When such a letterpress medium is irradiated with laser light, a larger quantity of gas and dust (which may hereinafter be collectively called gas in this specification) generates therefrom than from a conventional image recording medium. This results in a problem that the gas remaining uncollected by a gas suction mechanism re-adheres to and contaminates the surface of the image recording medium.

SUMMARY OF THE INVENTION

The object of this invention, therefore, is to provide an image recording apparatus in which gas and the like generated by laser irradiation do not seriously lower image quality even if the gas and the like re-adhere to the surface of an image recording medium.

The above object is fulfilled, according to this invention, by an image recording apparatus comprising a holder member for holding an image recording medium mounted on a surface thereof, an image recording device for emitting light beams modulated by image signals toward the image recording medium; a primary scanning device for causing the light beams to scan the image recording medium in a primary scanning direction by moving the light beams relative to the holder member; a secondary scanning device for moving the image recording device in a direction perpendicular to the primary scanning direction; and a gas blowing device for blowing out a first gas in a predetermined direction to blow away a second gas generated from the image recording medium irradiated by the light beams; wherein the image recording device has a plurality of light sources arranged in a direction intersecting the primary scanning direction; the light sources being arranged in such a positional relationship that each light source is located upstream, in the primary scanning direction, of a different light source located adjacent thereto and downstream thereof in the gas blowing direction.

With this image recording apparatus, the gas and the like generated by a light beam emitted from a certain light source is driven by a different gas blown out to move over an area exposed by a different light source adjoining that certain light source. Most of the gas and the like moved over the exposed area adhere to this area, without flowing over areas downstream thereof the gas blowing direction. Consequently, the surface of the image recording medium has no area where the gas and the like adhere locally, with little likelihood of variations in the adhesion of the gas and the like.

In one preferred embodiment, the holder member is a cylindrical member around which the image recording medium is wrapped, the primary scanning device is a motor for rotating the cylindrical member, and the image recording medium is a letterpress medium.

In another preferred embodiment, the light sources are arranged two-dimensionally.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
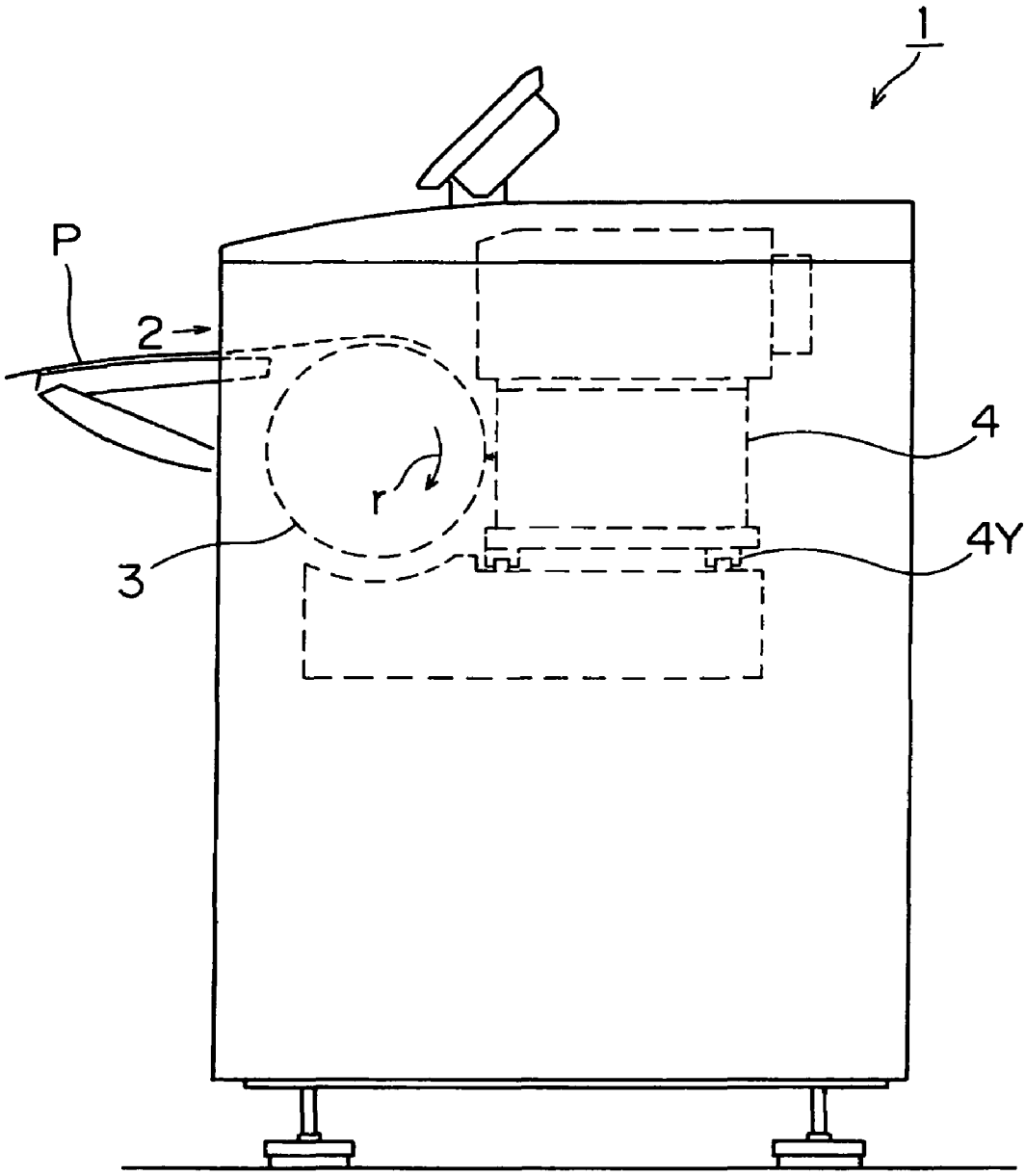
FIG. 1 is a see-through side view of an image recording apparatus.

FIG. 1 is a see-through side view of an image recording apparatus 1 which records an image on a flexo-digital plate P.

An unexposed flexo-digital plate P (hereinafter abbreviated as plate P) is introduced from outside through an opening 2 into the image recording apparatus 1, and is wrapped around a drum 3. The drum 3 is rotatable in the direction of arrow "r" by a rotating mechanism not shown. A recording head 4 is disposed opposite the drum 3. The recording head 4 is movable along the axis of rotation of the drum 3 (in the direction normal to the plane of FIG. 1) by a secondary scanning device 4Y. The drum 3 is rotated while laser light modulated by image signals is emitted from the recording head 4 toward the surface of plate P, whereby the surface of plate P undergoes primary scanning action of the modulated laser light. The surface of plate P undergoes secondary scanning action of the modulated laser light when the recording head 4 is moved along the axis of rotation of the drum 3 synchronously with rotation of the drum 3. In the following description, the scanning directions will be referred to as secondary scanning direction X and primary scanning direction Y.

The drum 3 is a hollow cylindrical member having an inner chamber. The inner chamber is connected through piping to a vacuum pump, not shown, disposed outside the drum 3.

Figure 2:
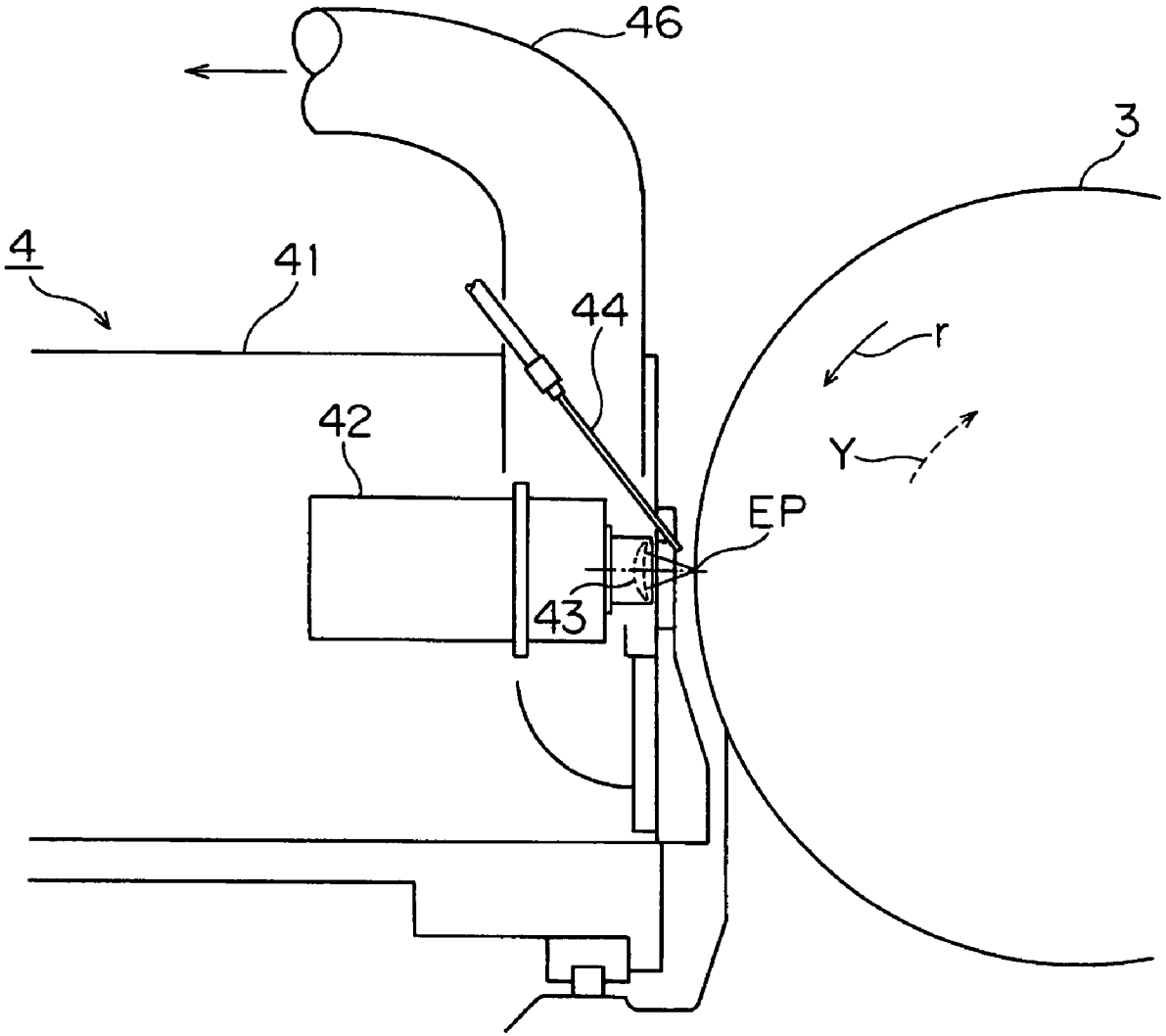
FIG. 2 is a side view showing an outline of a recording head.
Figure 3:
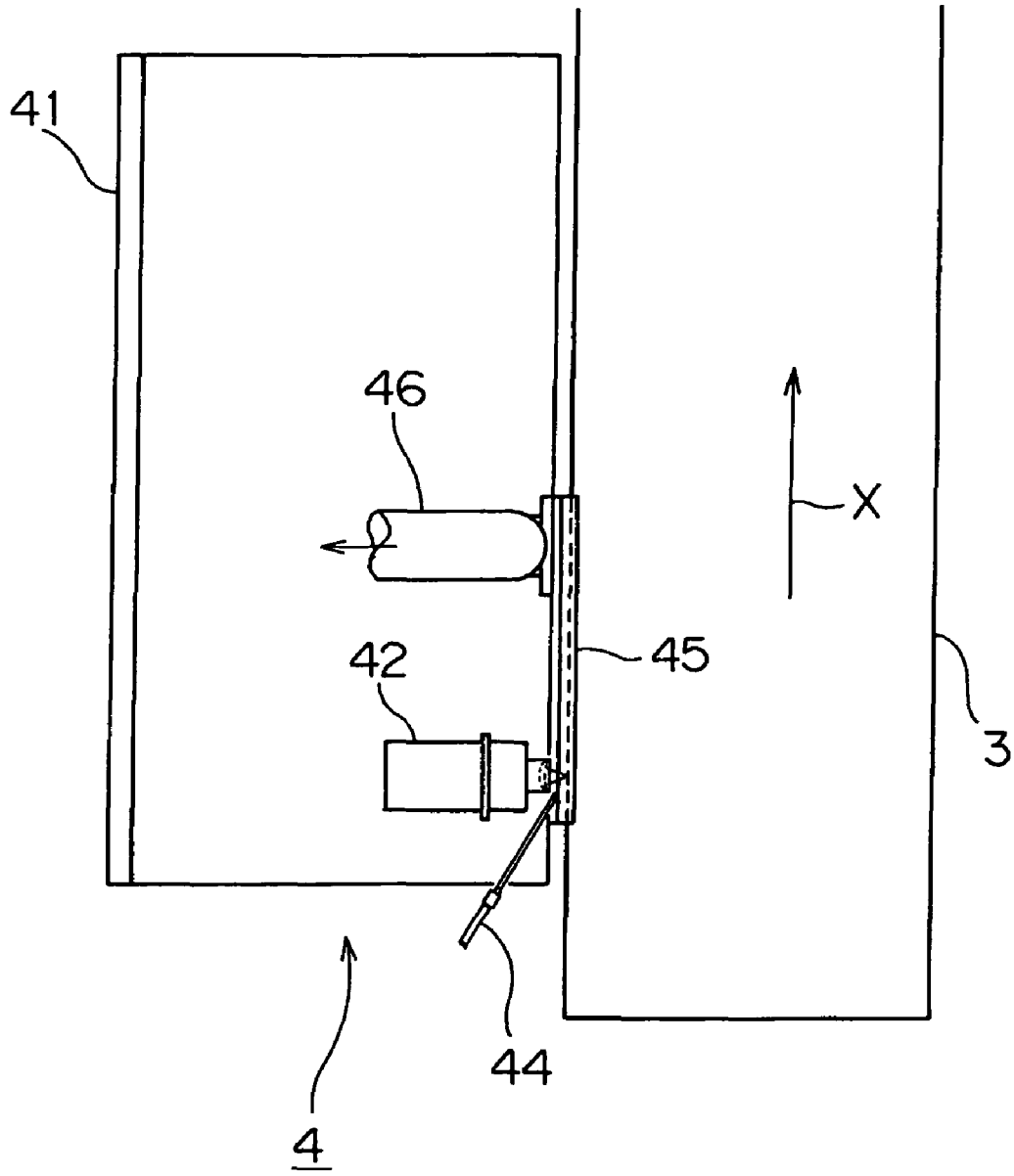
FIG. 3 is a top view of the recording head and a drum.
Figure 4:
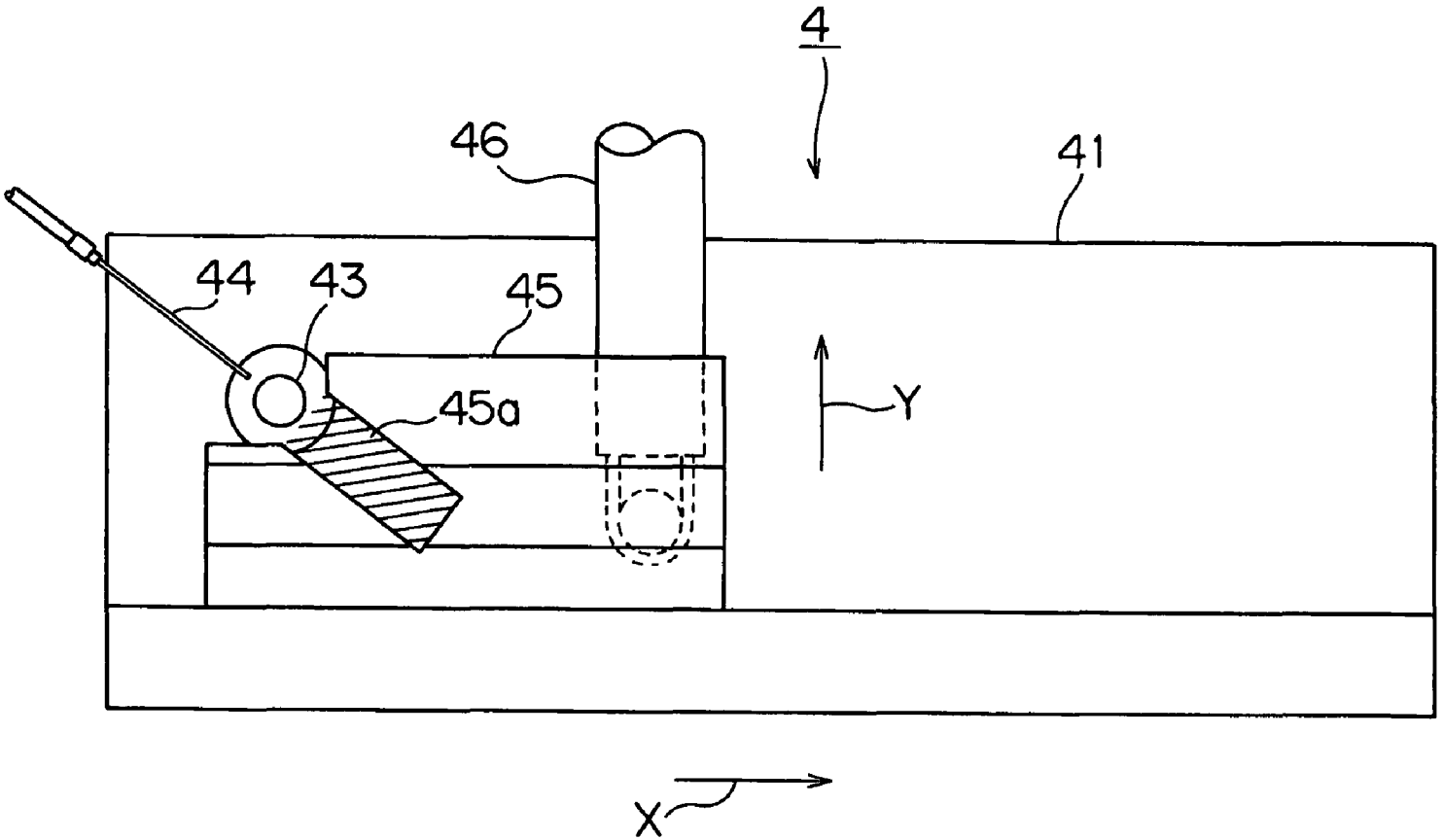
FIG. 4 is a front view of the recording head seen from the drum.

The construction of the recording head 4 will be described with reference to FIGS. 2 through 4. FIG. 2 is a side view showing an outline of the recording head 4. FIG. 3 is a top view of the recording head 4 and drum 3. FIG. 4 is a front view of the recording head 4 seen from the drum 3.

As shown in FIG. 2, the recording head 4 includes a housing 41 with a laser source 42 mounted therein for emitting laser light. The laser light emitted from the laser source 42, with the action of a lens 43, forms an image at a point EP on the surface of the drum 3 (actually, on the plate P wrapped around the drum 3). When the plate P is irradiated with the laser light, gas and dust will be generated. In order to dispose of the gas and the like, an air blowoff pipe 44, a case 45 and a gas suction pipe 46 are arranged on the front of the housing 41.

The air blowoff pipe 44 blows high-speed air purified by a filter, from above the laser source 42 (that is, from downstream of the laser source 42 in the primary scanning direction Y) and from upstream in the secondary scanning direction X toward the laser irradiation point EP. This produces an airflow in a direction turned approximately 45 degrees clockwise from the primary scanning direction Y in FIG. 4, which blows away the gas and the like generating from the plate P.

The case 45 is a box-like member which prevents further diffusion of the diffused gas, and has an opening formed in a part of its surface opposed to the drum 3. That is, the hatched portion 45*a* in FIG. 4 is the opening of the case 45. The gas suction pipe 46 is connected to the case 45 in a position thereof downstream in the secondary scanning direction X.

Figure 5:
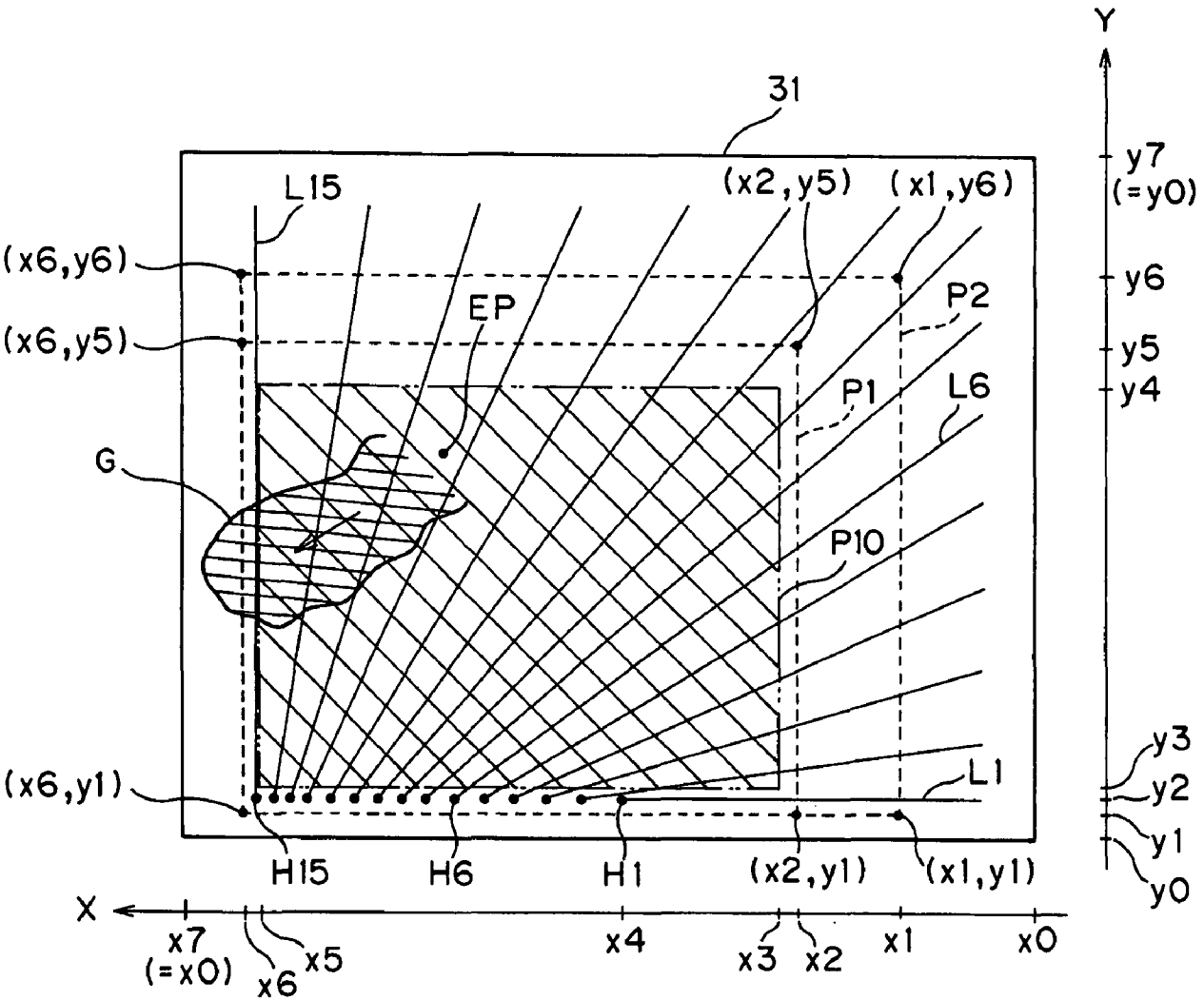
FIG. 5 is a developed view on a drum surface.

Directions and positions of suction grooves formed in the surface 31 of the drum 3 will be described with reference to FIG. 5. FIG. 5 is a developed view of the surface 31 of the drum 3. FIG. 5 shows, for reference, an X-axis of coordinates corresponding to the secondary scanning direction X, and a Y-axis of coordinates corresponding to the primary scanning direction Y.

Different size plates P can be mounted on the surface 31 of the drum 3. FIG. 5 shows two plates, i.e. a small size plate P1 and a large size plate P2, by way of example. Specifically, the small plate P1 is a rectangle having vertices at point (x2, y1), point (x2, y5), point (x6, y5) and point (x6, y1). The large plate P2 is a rectangle having vertices at point (x1, y1), point (x1, y6), point (x6, y6) and point (x6, y1).

In order to attach such different size plates P, 15 suction grooves L1-L15 are formed in the drum surface 31 to have different angles of inclination relative to the secondary scanning direction X. The suction grooves L1-L15 extend from the same position in the primary scanning direction Y (i.e. from position y2 of Y coordinates), and from different positions in the secondary scanning direction X (between position x4 and position x5 inclusive of X coordinates). The suction grooves L1-L15 have suction bores H1-H15 formed in predetermined bottom positions thereof, respectively, for communication with the inner chamber of the drum 3. In FIG. 5, the suction grooves L2-L5 and L7-L14 and suction bores H2-H5 and H7-H14 are not affixed with the reference signs to avoid complication of the illustration.

The suction groove L1 extends parallel to the secondary scanning direction X. The suction bore H1 is formed in the position, the most downstream in the secondary scanning direction X, of the suction groove L1.

The suction groove L6 extends in a direction inclined approximately 45 degrees counterclockwise relative to the secondary scanning direction X. The suction bore H6 is formed in the position, the most downstream in the secondary scanning direction X, of the suction groove L6. The suction groove L15 extends parallel to the primary scanning direction Y.

The suction grooves L2-L15 other than the suction groove L1 are formed to cross the secondary scanning direction X at different angles, respectively. The suction bores H2-H15 are formed in the positions, the most upstream in the primary scanning direction Y, i.e. the nearest to origin y0 of the primary scanning direction Y, of the respective suction grooves L2-L15.

The position of coordinates (x6, y1) is used as reference for attaching any size plate P to the drum surface 31. Thus, the lower left point of plate P is common to all plate sizes, and an increase in the plate size entails an enlargement in the direction −X counter to the secondary scanning direction X or in the primary scanning direction Y. The position identified by coordinates (x6, y1) is called a reference position for attaching plates P.

FIG. 5 schematically shows how the gas G generating from the laser irradiation point EP is driven upstream of the point EP in the primary scanning direction Y, and down-stream of the point EP in the secondary scanning direction X, by the air blown from the air blowoff pipe 44.

The laser source 42 of this image recording apparatus 1 is a multichannel type light source having a plurality of semiconductor lasers arranged two-dimensionally (e.g. in a lattice arrangement of six semiconductor lasers in total, consisting of three rows in the primary scanning direction and two rows in the secondary scanning direction).

Figure 6:
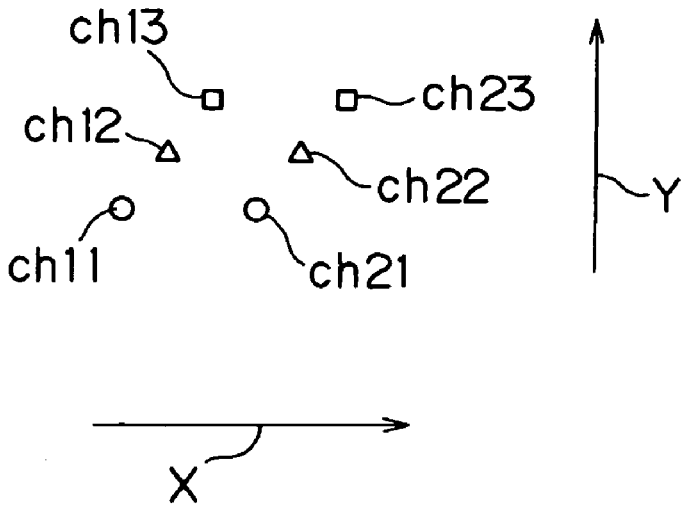
FIG. 6 is a view showing an example of arrangement of a plurality of semiconductor lasers.

FIG. 6 is a view showing an example of arrangement of a plurality of semiconductor lasers ch in the laser source 42. A plurality of semiconductor lasers ch11, 12 and 13 located upstream in the secondary scanning direction X form a first row of light sources inclined relative to the primary scanning direction Y. A plurality of semiconductor laser ch21, 22 and 23 located downstream in the secondary scanning direction X form a second row of light sources inclined relative to the primary scanning direction Y.

When image recording is started, semiconductor lasers ch13 and 23, located most downstream in the primary scanning direction Y, in the respective rows of light sources will emit light first. The remaining semiconductor lasers ch11, 12, 21 and 22 will successively emit light, under timing control, after delays corresponding to their distances from these lasers ch13 and ch23 in the primary scanning direction.

Figure 7A:
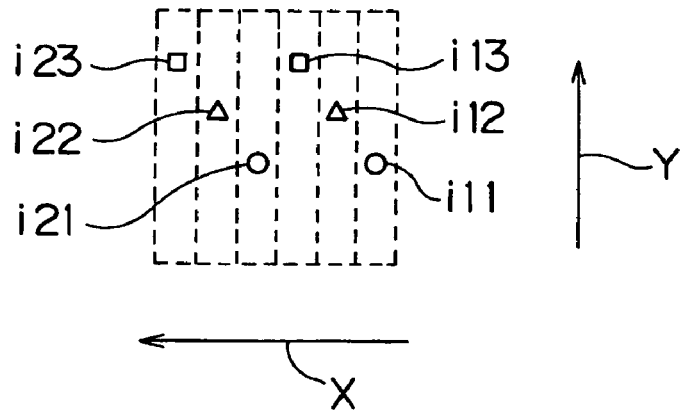
FIG. 7A is an explanatory view of a flexo-digital plate making process.

FIG. 7A shows an arrangement of semiconductor laser light source images (i11, i12, i13, i21, i22 and i23) formed on the plate P by laser beams emitted from the plurality of semiconductor lasers ch.

The light source images i11, i12 and i13 upstream in the secondary scanning direction X are images formed on the surface of plate P by the light beams emitted from the semiconductor laser sources ch11, 12 and 13. These light source images i11, i12 and i13 form a first row of light source images inclined relative to the primary scanning direction Y.

The light source images i21, i22 and i23 downstream in the secondary scanning direction X are images formed on the surface of plate P by the light beams emitted from the semiconductor laser sources ch21, 22 and 23. These light source images i21, i22 and i23 form a second row of light source images inclined relative to the primary scanning direction Y.

Figure 7B:
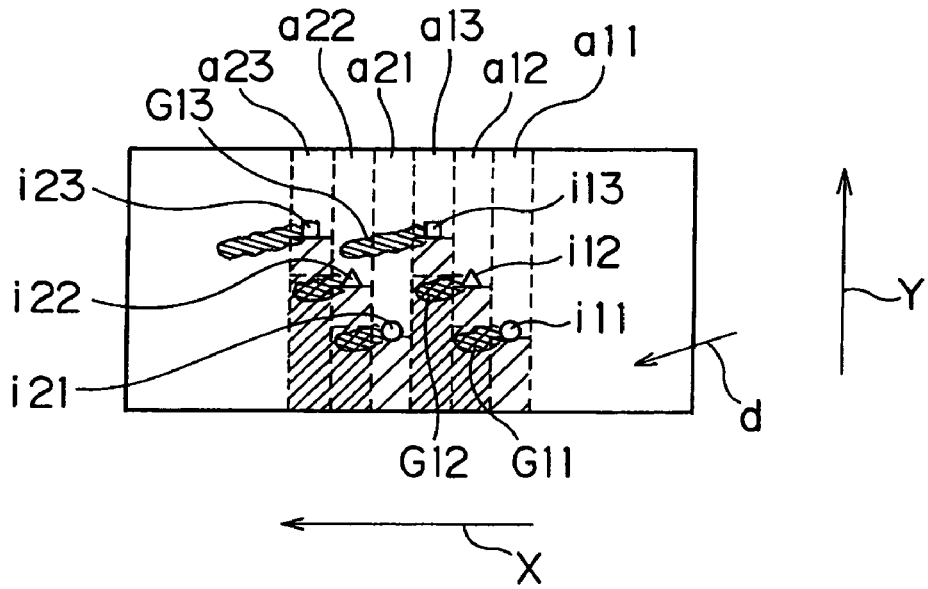
FIG. 7B is an explanatory view of the flexo-digital plate making process.

FIG. 7B is a schematic view illustrating a positional relationship between scan areas (a11, a12, a13, a21, a22 and a23) scanned by the semiconductor lasers ch and the light source images (i11, i12, i13, i21, i22 and i23). The hatched portions of the scan areas (a11, a12, a13, a21, a22 and a23) are those already irradiated with the laser beams by the time of illustration.

Gas and dust (gas G11) are generated from the light source image i11 of the semiconductor laser ch11. The air blowoff pipe 44 described hereinbefore causes the gas G11 to flow over the area a12 already irradiated by the laser beam from the laser source ch12, and located downstream in an air blowing direction "d".

This plate P has such a property that is adsorptivity of gas and the like changes as a result of laser irradiation. That is, adhesion increases in laser-irradiated areas of this plate P. Therefore, a laser-irradiated area will more readily adsorb gas flowing thereover than an unexposed area.

Since the gas G11 flows over the laser-irradiated portion of the area a12, part of the gas G11 is adsorbed to this portion, and only the remaining part of the gas G11 is collected through the opening 45*a* into the case 45.

Gas G12 generated from the light source image i12 is driven to flow over the scan area a13 irradiated with the laser light. Since the gas G12 flows over the laser-irradiated portion of the scan area a13, this portion adsorbs part of the gas G12. Only the remaining part of the gas G12 is collected through the opening 45*a* into the case 45.

Gas G13 generated from the light source image i13 flows over unexposed portions of the areas a21 and a22. Since the gas adsorptivity of these portions is almost the same and as low as before image recording, most of the gas G13 is collected through the opening 45*a* into the case 45 without re-adhering to the surface of plate P.

Re-adhesion of the gas generated from the plate P as a result of laser emission from the second row of light sources is similar to the above, and will not be described.

Figure 7C:
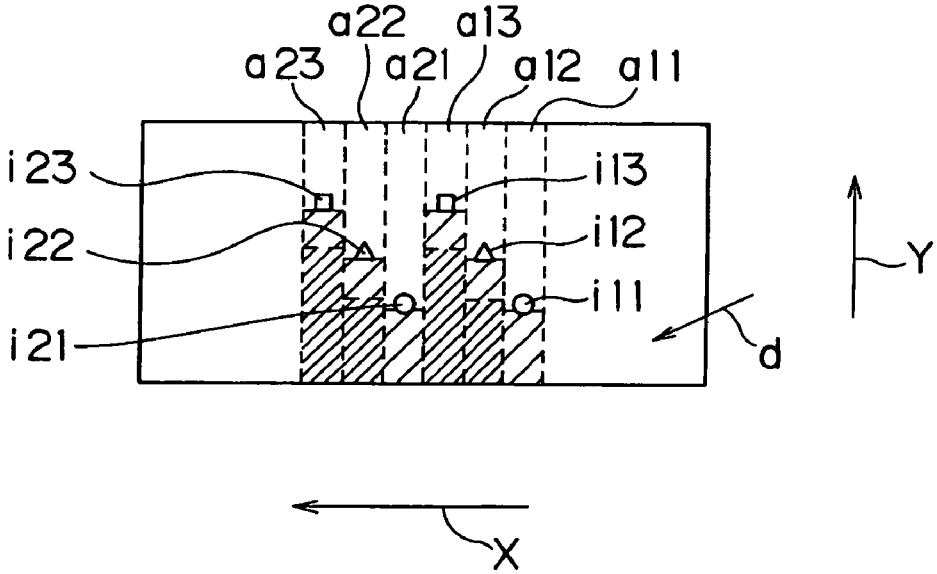
FIG. 7C is an explanatory view of the flexo-digital plate making process.

FIG. 7C is a view showing a state of re-adhesion of the gas and the like to the plate P. The scan area all the most upstream in the air blowing direction "d" is free from adhesion of the gas generated by laser emission from the other light sources. The scan area a12 next upstream in the air blowing direction "d" has, adhering thereto, only the gas G11 generated immediately upstream in the air blowing direction "d" by laser emission from the semiconductor laser ch11. Further, the scan area a13 has, adhering thereto, only the gas G12 generated immediately upstream in the air blowing direction "d" by laser emission from the semiconductor laser ch12.

In the second row of semiconductor laser sources, the scan area a21 formed most upstream in the air blowing direction "d" by the semiconductor laser ch21 has the gas from the scan areas of the other semiconductor lasers attached thereto before image formation by the semiconductor laser ch21. However, these adhering elements are removed by laser emission from the semiconductor laser ch21, and therefore have little or no influence. The scan areas a22 and a23 undergo, only once, adhesion thereto of the gas from the scan areas of the other semiconductor lasers, as do the scan areas a12 and a13.

As described above, most of the scan areas (a11, a12, a13, a21, a22 and a23) undergo, only once, adhesion thereto of the gas generated by the other semiconductor lasers. No scan area has the gas generated by the other semiconductor lasers adhering thereto a plurality of times. Consequently, in this example, the gas adheres to the surface of plate P as distributed uniformly, without concentrating on particular areas. Thus, the re-adhering gas hardly lowers the quality of images formed on the plate P.

Figure 8:
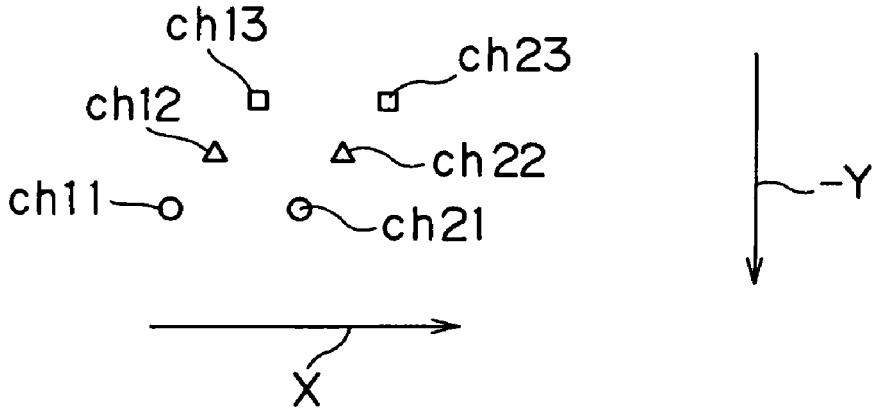
FIG. 8 is a view showing a comparative example of arrangement of a plurality of semiconductor lasers.

FIGS. 8 and 9 are comparative diagrams illustrating a state of re-adhesion of gas and the like at the time of rotating the drum 3 in a direction −r opposite to the case shown in FIGS. 6 and 7.

Since the drum 3 rotates in the opposite direction, the primary scanning direction also is opposite to the direction shown in FIGS. 6 and 7 (to distinguish the opposite directions, the primary scanning direction being referenced −Y in FIGS. 8 and 9). The secondary scanning direction X and air blowing direction "d" are the same as those in FIGS. 6 and 7.

The plurality of semiconductor lasers ch11, 12 and 13 located upstream in the secondary scanning direction X form a first row of light sources inclined relative to the primary scanning direction −Y. The plurality of semiconductor laser ch21, 22 and 23 located downstream in the secondary scanning direction X form a second row of light sources inclined relative to the primary scanning direction −Y. However, as distinct from the example shown in FIGS. 6 and 7, the semiconductor laser ch11 (ch21) located the most upstream in the air blowing direction "d" among the plurality of semiconductor lasers ch belonging to each row is located the most downstream in the primary scanning direction −Y.

Figure 9A:
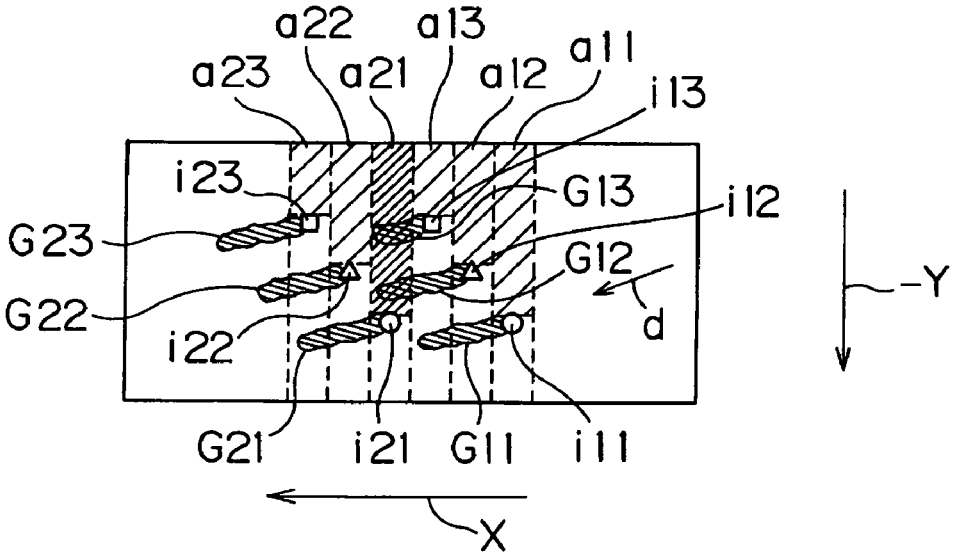
FIG. 9A is an explanatory view of a flexo-digital plate making process in the comparative example.

FIG. 9A is a schematic view showing images i11, i12, i13, i21, i22 and i23 of the plurality of semiconductor lasers ch11, ch12, ch13, ch21, ch22, and ch23, and gas, dust and the like (G11, G12, G13, G21, G22 and G23) generating from the light source images.

Gas G11 generated from the light source image i11 is driven by the air blowoff pipe 44 described hereinbefore to flow over an unexposed portion of the scan area a12 located downstream in the air blowing direction "d". Thus, the gas G11 flows further downstream in the air blowing direction "d" without being adsorbed to the scan area a12.

Gas G12 generated from the light source image i12 is driven to flow over the scan areas a13 and a21. While the former is an unexposed portion, the latter is a portion irradiated by the laser beam emitted from the semiconductor laser ch21 and therefore easily adsorptive of gas and the like. Thus, part of the gas G12 is adsorbed to the laser-irradiated portion of the scan area a21, and the remainder is collected through the opening 45*a* into the case 45.

Gas G13 generated from the light source image i13 flows over the laser-irradiated portion of the scan size a21. This portion adsorbs part of the gas G13, and the remainder is collected through the opening 45*a* into the case 45.

Thus, the gas and the like generated from the plurality of light source images i11, i12 and i13 belonging to the first row of light source images are adsorbed in the largest quantity to the laser-irradiated portion of the scan area a21 corresponding to the light source ch21 and located the most upstream in the air blowing direction "d", and are little adsorbed to other portions. In other words, by far the largest quantity of gas and the like re-adheres to the scan area a21 among the scan areas a11, 12, 13, 21, 22 and 23.

Figure 9B:
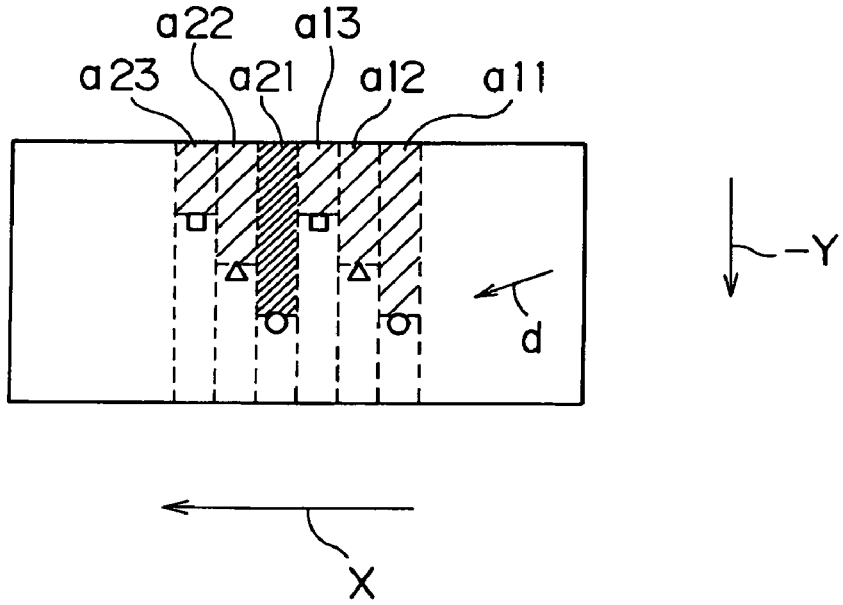
FIG. 9B is an explanatory view of the flexo-digital plate making process in the comparative example.

FIG. 9B is a view showing a state of re-adhesion of the gas and so on to the plate P in the comparative example. As a result of the gas adhering in a large quantity to the scan area a21, this area becomes thicker than the other areas, thereby greatly lowering the quality of images formed on the plate P.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2007-004068 filed in the Japanese Patent Office on Jan. 12, 2007, the entire disclosure of which is incorporated herein by reference.

What is claimed is:

1. An image recording apparatus comprising:

a holder member for holding an image recording medium mounted on a surface thereof;

an image recording device for emitting light beams modulated by image signals toward said image recording medium;

a primary scanning device for causing said light beams to scan said image recording medium in a primary scanning direction by moving said light beams relative to said holder member;

a secondary scanning device for moving said image recording device in a direction perpendicular to said primary scanning direction; and a gas blowing device for blowing out a first gas in a direction intersecting and inclined to said primary scanning direction on a surface along the image recording medium to blow away a second gas generated from said image recording medium irradiated with said light beams;

wherein said image recording device has a plurality of light sources arranged in a direction intersecting and inclined to said primary scanning direction;

said light sources being arranged in such a positional relationship that each light source is located upstream, in said primary scanning direction, of a different light source located adjacent thereto and downstream thereof in said gas blowing direction.

2. An image recording apparatus as defined in claim 1, wherein:

said holder member is a cylindrical member around which said image recording medium is wrapped; and said primary scanning device is a motor for rotating said cylindrical member.

3. An image recording apparatus as defined in claim 2, wherein said image recording medium is a letterpress medium.

4. An image recording apparatus as defined in claim 3, wherein said light sources are arranged two-dimensionally.

* * * * *